US005791800A

United States Patent [19]

Katz

[11] Patent Number: 5,791,800

[45] Date of Patent: Aug. 11, 1998

[54] DEVICE FOR APPLYING PASTE-LIKE MATERIALS, IN PARTICULAR MASCARA

[75] Inventor: Otto Katz, Schwabach, Germany

[73] Assignee: georg karl geka-brush GmbH, Bechhofen-Waizendorf, Germany

[21] Appl. No.: 657,102

[22] Filed: Jun. 3, 1996

[30] Foreign Application Priority Data

Jun. 1, 1995 [DE] Germany ..... 195 20 134.5

[51] Int. Cl.[6] ..... A45D 40/26

[52] U.S. Cl. ..... 401/122; 401/129; 132/218

[58] Field of Search ..... 401/122, 129; 132/218, 313, 317

[56] References Cited

U.S. PATENT DOCUMENTS

| | | | |
|---|---|---|---|
| 3,372,424 | 3/1968 | Kellet | 401/122 |
| 3,471,244 | 10/1969 | Melocchi | 401/122 |
| 4,403,624 | 9/1983 | Montgomery | 132/218 |
| 4,802,747 | 2/1989 | Cole | 401/122 |
| 4,854,759 | 8/1989 | Morane et al. | 401/124 |
| 4,886,387 | 12/1989 | Goldberg | 401/122 |
| 5,349,972 | 9/1994 | Dirksing et al. | 482/122 |

*Primary Examiner*—Jerome Donnelly
*Attorney, Agent, or Firm*—Browdy and Neimark

[57] ABSTRACT

A mascara applicator includes a receptacle, a pre-stripper and an end stripper, wherein the pre-stripper is associated with a brush and the end stripper is associated with a shaft. The shaft in turn is fixed to the brush and a screw cap. In the screwed-in position, the shaft is simultaneously grasped by segments of the pre-stripper and by stripper lips of the end stripper. Also, the pre-stripper has radially elastic segments which can pivot around a pivoting edge and which have slits which can be changed in width whereby radial forces can be transmitted to the segments by means of a spring loop.

14 Claims, 1 Drawing Sheet

DEVICE FOR APPLYING PASTE-LIKE MATERIALS, IN PARTICULAR MASCARA

BACKGROUND OF THE INVENTION

1. Technical Field of the Invention

The invention relates to a device for applying paste-like materials, in particular mascara.

2. Prior Art

Devices of this generic type should fulfill the purpose of applying mascara as finely and evenly as possible to a brush and distributing the mascara all around it in order to achieve a clump-free coverage of the eyelashes.

It is known that in devices of this kind, a brush is dipped into a container of material. Upon application, the brush, which is attached to a screw cap via a shaft, is unscrewed and withdrawn axially from the receptacle. A stripper disposed at the exit opening of the receptacle contacts the brush shaft before the withdrawal. When the brush is withdrawn, first, material is stripped from the brush shaft and then the brush is freed of coarse accumulations of material when it is pulled through the stripper lips. In this connection, it is disadvantageous that the moistening of the brush produces various results. When the receptacle is completely full, generally an overdose occurs on the brush. Since an application cannot take place with this over-moistening, a stripping of the over-dosed material on a paper or cloth towel is required. As a result, upon application, a part of the valuable cosmetic material is already spent unused.

A further disadvantage is comprised in that upon withdrawal of the brush, a so-called "flag" is produced, which means that not only is the brush itself impregnated overfull with material, but also an elongation of the brush in the form of material is produced. This surplus, too, must be removed unused before application.

OBJECT AND SUMMARY OF THE INVENTION

The object of the invention is to eliminate the overdosing on the brush, which is a considerable disadvantage for the application, and to prevent the material from clinging to the brush. In this way, a better application and a more economical use of material is achieved.

In the device according to the invention, a pivot region of segments of a pre-stripper is provided which gradually lays stripper edges against the shaft, then against the twisted rod, and finally, after the complete withdrawal of the brush from the region of the pre-stripper, by the reciprocal touching of the stripper edges.

It is advantageous that when their stripper edges are laid against the twisted rod, the segments of the pre-stripper form slit widths which are reduced in size and which represent a reduced opening for the material and consequently limit this to a minimum and as a result, retain it in the receptacle to a large extent.

The material is applied to the brush in longitudinal stripes by the slits in the pre-stripper. Since the brush normally has a circular cross section, the application is executed in the shape of a star.

Upon further withdrawal of the brush, the longitudinal stripes of material meet the stripper lips of the end stripper. This creates a damming edge for the material and causes a lateral distribution of the material on the brush.

In order to prevent the "flag" which is produced upon withdrawal of the brush, the segments spring together in such a way that their stripper edges come to rest against one another so that there is a slit width with a zero value at the stripper edges.

A spring loop, which supports the elasticity of the segments, is embodied as a flat coil spring with a maximal number of 1.5 turns. This provides that the spring ends are broadened tangentially to the spring diameter.

The advantages which can be achieved by the invention are comprised in particular in that an even moistening of the brush is produced both axially and radially, and an overdosing is prevented.

It is furthermore achieved that the brush end does not draw any material after it since the elastic segments of the pre-stripper remove this overhang at the end of the twisted rod.

The longer service life of the device is also advantageous since with each application, only the material which can be respectively used is taken out of the receptacle and consequently, there is no lost surplus.

The pre-stripper can be combined with the end stripper and the spring loop into one structural unit and can consequently be separately manufactured as a preassembly/subassembly and can be used in commercially available devices.

An exemplary embodiment of the invention is shown in the drawings and further explained below.

DETAILED DESCRIPTION OF THE PREFERRED EMBODIMENT(S)

Figure 1:
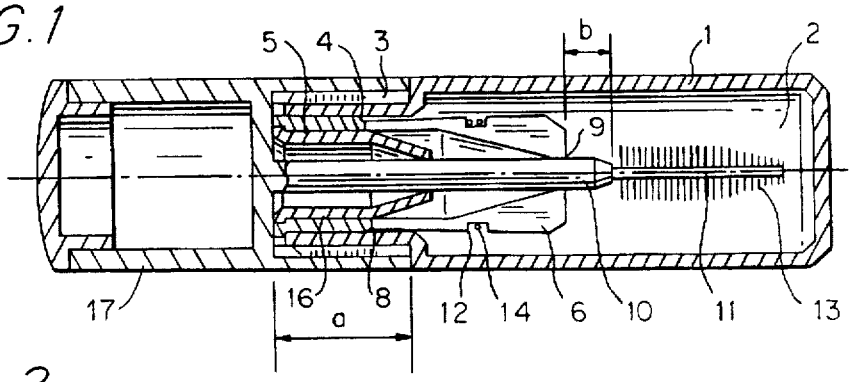
FIG. 1 shows a longitudinal section through the device when not in use.

A receptacle 1 contains a material 2. The receptacle opening has an external thread 3 and a bore 4. A pre-stripper 5 is fastened in the bore 4, which pre-stripper is comprised of four elastic segments 6, which extend over the length of slits 7. The segments 6 can be pivoted radially via a pivoting edge 8 and rest against a shaft 10 with stripper edges 9 in the state of repose.

In the stripping phase, the segments 6 pivot against the smaller diameter of a twisted rod 11, which is attached in the shaft 10. The bristles of a brush 13 are fastened in the twisted rod 11 in a known manner. To support the radial elasticity of the segments 6, a groove 12 is provided in their circumference, which groove contains a spring loop which is comprised of at least 1.25 turns of a flat coil spring 14. As a result, an overlapping of the spring ends 15 and 15' is produced, which is calculated in such a way that even with the greatest possible elastic expansion of the segments 6 by the shaft 10, an overlapping still exists. As a result, a meeting of the spring ends 15 and 15' on their end faces is prevented in order to achieve an unhindered radial contraction of the coil spring 14.

So that the spring ends 15, 15' do not tear up the bottom of the groove 12 and the slits 7, it is provided that the spring ends 15, 15' are tangentially guided out of the spring circle.

The spring loop can be a toroidal sealing ring 14' formed of an elastic rubber material rather than a coil spring 14.

An end stripper 16 is coaxially attached in the non-slit region of the pre-stripper 5. This end stripper is preferably made of soft, elastic material and, in a known manner, has stripper lips which enclose the shaft 10. The latter is connected to the screw cap 17.

The invention functions as follows:

Starting at FIG. 1, the device is in a position of repose. The brush 13 is dipped into the material 2. The segments 6 of the pre-stripper 5 rest against the shaft 10. The spring loop 14, 14' is at its greatest elastic expansion. The end stripper 16, which is fixed to the pre-stripper 5, likewise rests against the shaft 10, but in contrast to the stripper edges 9 of the segments 6, the stripper lips [of the pre-stripper 5] enclose the shaft 10 in a sealing manner.

Figure 2:
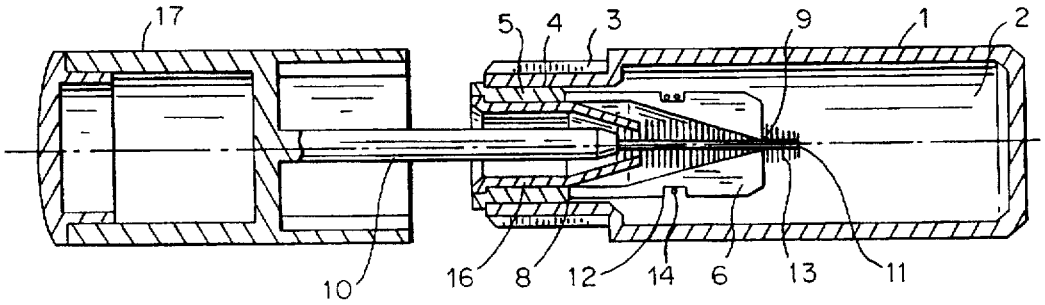
FIG. 2 shows a longitudinal section during withdrawal.
Figure 3:
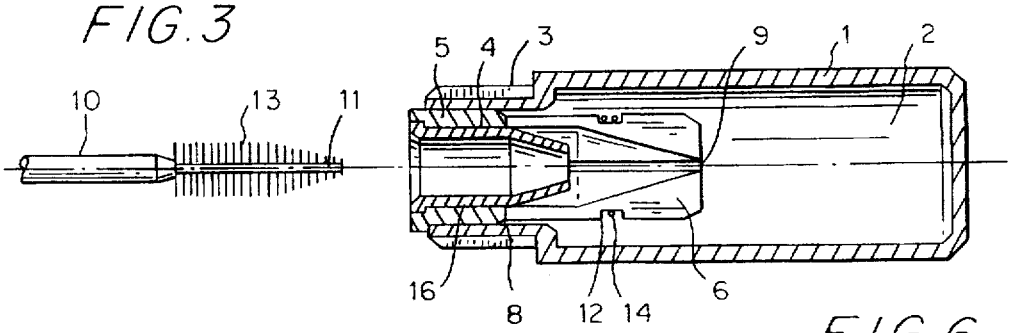
FIG. 3 shows a longitudinal section after withdrawal.
Figure 6:
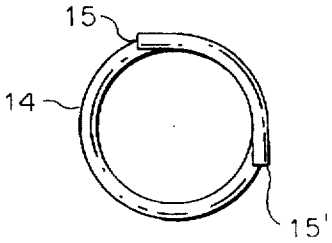
FIG. 6 shows a top view of the spring loop.
Figure 4:
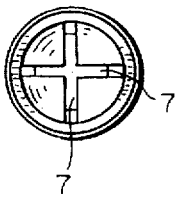
FIG. 4 shows a front view of the pre-stripper.
Figure 5:
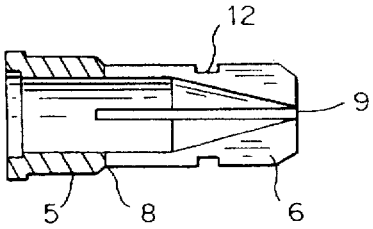
FIG. 5 shows a longitudinal section of the pre-stripper.
Figure 7:
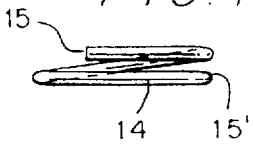
FIG. 7 shows a side view of the spring loop formed a flat coil spring.
Figure 8:
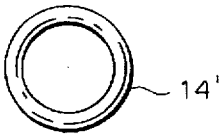
FIG. 8 shows a top view of the spring loop formed as a toroidal sealing ring.

Upon unscrewing and withdrawal of the screw cap 17 (FIG. 2), the segments 6 spring together radially until their stripper edges 9 come to rest against the twisted rod 11 of the brush 13. As a result, this is combed through over its entire length, wherein the only material which remains on the brush 13 is that which can pass through the slits 7. As soon as the end of the brush 13 and of the twisted rod 11 have reached the stripper edges 9, the stripper edges 9 fall against one other under the force of spring loop 14 and cut short any material flag being pulled after. The brush 13 is linearly moistened in the region between the stripper lips of the end stripper 16 and the stripper edges 9 of the segments 6, in correspondence with the openings which are determined by the slits 7. When the brush 13 meets the stripper lips of the end stripper 16, the particles of material are partially dammed against the stripper lips and as a result, are collected in a ring shape at the stripper lips, by means of which a distribution all around the brush 13 is achieved. Since the stripper edges 9 of the pre-stripper 5 have to a large extent combed the core region of the brush 13 empty, the distribution of the material is limited to the region of the surface of the brush by means of the damming at the end stripper 16.

As already noted above, the pre-stripper 5 can be combined with the end stripper 16 and the spring loop (whether the coil spring 14 or the torodial sealing ring 14') into one structural unit which can be separately manufactured as a subassembly for use in already available devices.

I claim:

1. A device for applying paste materials having a receptacle, a pre-stripper, and an end stripper, wherein the pre-stripper is slidably engaged with a brush, and the end stripper is slidably engaged with a shaft, wherein the shaft is fixed to the brush and the screw cap, wherein in a screwed-in position, the shaft (10) is simultaneously engaged by segments (6) of the pre-stripper (5) and by stripper lips of the end stripper (16), wherein the pre-stripper (5) is comprised of the radially elastic segments (6), which pivot around a pivoting edge (8) and which in relation to one another, constitute slits (7) which can be changed in width, and that radial forces are transmitted to the segments (6) by means of a spring loop.

2. The device according to claim 1, wherein a pivot angle of the segments (6) is determined by the gradual laying of a stripper edge (9) against the shaft (10), as well as against a twisted rod (11) and by the reciprocal touching of the stripper edges (9) against one another after withdrawal of the brush (13).

3. The device according to claim 2, wherein upon contact of the stripper edges (9) against the twisted rod (11), the segments (6) constitute slits (7), which are reduced in width and represent an opening for the material (2).

4. The device according to claim 1, wherein the material (2) can be applied to the brush (13) in longitudinal stripes by means of the slits (7).

5. The device according to claims 4, wherein after withdrawal of the brush (13) along with the twisted rod (11), there is a slit width of the value zero at the stripper edges (9).

6. The device according to claim 1, wherein the stripper lips of the end stripper (16) constitute a damming edge for the longitudinal stripes of material (2) disposed on the brush (13).

7. The device according to claim 1, wherein the spring loop is embodied as a flat coil spring with up to a maximum number of 1.5 turns and that spring ends (15 & 15') of said spring loop are tangentially extended away from a circle of the spring loop.

8. The device according to claim 7, wherein the spring loop is a toroidal sealing ring of an elastic rubber material.

9. The device according to claim 1, wherein the length (a) of the external thread (3) is longer than the projection (b) of the shaft (10).

10. The device according to claim 1, wherein the working parts comprised of the pre-stripper (5) with segments (6), the spring loop (14), and the end stripper (16) can be formed as a separate structural unit.

11. The device according to claim 10, wherein the separate structural unit can be used in commercially available products.

12. The device according to claim 1 wherein after withdrawal of the brush (13) along with the twisted rod (11), there is a slit width of the value zero at the stripper edges (9).

13. The device according to claim 2 wherein after withdrawal of the brush (13) along with the twisted rod (11), there is a slit width of the value zero at the stripper edges (9).

14. The device according to claim 3 wherein after withdrawal of the brush (13) along with the twisted rod (11), there is a slit width of the value zero at the stripper edges (9).

* * * * *